United States Patent [19]

Duxbury

[11] Patent Number: 4,943,703

[45] Date of Patent: Jul. 24, 1990

[54] APPLIANCE STAND HAVING AN ELECTRICAL CONNECTOR

[75] Inventor: Eric Duxbury, Walsall, England

[73] Assignee: D.H. Haden Ltd., England

[21] Appl. No.: 307,320

[22] Filed: Feb. 6, 1989

[30] Foreign Application Priority Data

Feb. 6, 1988 [GB] United Kingdom ..... 8802739

[51] Int. Cl.[5] ..... H01R 13/703

[52] U.S. Cl. ..... 219/247; 38/82; 200/51.09; 439/568

[58] Field of Search ..... 439/568, 929; 38/75, 38/82; 200/51.09, 574; 219/246, 247, 256, 257; 248/117.1, 117.2, 117.3, 117.4, 117.5, 117.6, 117.7

[56] References Cited

U.S. PATENT DOCUMENTS 4,707,042 11/1987 Haden ..... 439/140

4,815,992 3/1989 Aranzabal ..... 439/620

*Primary Examiner*—Gary F. Paumen

*Attorney, Agent, or Firm*—Neil F. Markva

[57] ABSTRACT

Electrical apparatus comprising an appliance, a stand to support the appliance and an electrical connector device which can be selectively coupled mechanically to either the appliance or the stand, by coupling means incorporating a bistable mechanism so that the appliance can be used selectively in a corded manner or a cordless manner.

11 Claims, 4 Drawing Sheets

APPLIANCE STAND HAVING AN ELECTRICAL CONNECTOR

FIELD OF THE INVENTION

This invention concerns electrical connectors and devices, and apparatus including electrical connectors.

BACKGROUND OF THE INVENTION

Electrical appliances are known which have an electrical supply cable fixed thereto, and other appliances are known which are releasably connectable to an electricity supply by a separable electrical connector of which one part is incorporated in the appliance and the other part is connected to an electrical supply cable, so that the latter can be removed easily from the appliance. Such appliances are often called "corded" appliances.

So called "cordless" electrical appliances are known which are easily connectable to an electricity supply by an electrical connector device, which connector device is incorporated in a base or like stand, effects an electrical connection with input terminals of the appliance automatically when the latter is supported by the stand, and is connected to an electrical supply cable. The stand may incorporate an electrical switch between the cable and the connector device to switch off the connector device when the appliance is removed from the stand.

Corded and cordless appliances each have respective disadvantages. For example, the cord or supply cable can be a hindrance when using a corded appliances, and the repeated flexing of the supply cable often causes the cable to fail; whereas cordless appliances have to store such energy as may be necessary for their operation when removed from the stand, and the types of appliance are thus restricted to those which require little or no such energy, e.g. electric kettles in which heating is performed while the kettle is supported by the stand and stops upon removal, electric flat irons in which the necessary energy is stored as heat, and low-power electrical devices such as lamps in which the energy is stored electrically in a rechargeable cell.

SUMMARY OF THE INVENTION

The present invention faces the problem of reducing these disadvantages; and to overcome the problem the invention provides forms of electrical apparatus comprising an appliance, a stand to support the appliance and an electrical connector device which can be selectively coupled mechanically to either the appliance or the stand, so that the appliance can be used selectively in a corded manner or a cordless manner.

In general the invention includes and provides an appliance, stand or electrical connector device, for use in apparatus comprising an appliance, a stand or like support, and an electrical connector device; comprising a mechanism, which mechanism is bistable and is actuable by a single operation to shift between a first state (in which the support and connector device are coupled for supporting and energizing the appliance) and a second state (in which the connector device is released from the support and the connector device is coupled mechanically to the appliance).

In accordance with the present invention there is more particularly provided apparatus of a kind comprising a base, support or like stand, an electrical connector device and at least one electrical appliance; and characterized in that said apparatus comprises a bistable mechanism which is arranged to control operation of first and second detents, is stable in a first condition in which the first detents mechanically couple the device to the stand, is stable in a second condition in which the second detents mechanically couple the device to the appliance, and is actuable to move from either of said conditions to the other thereof.

In particular, the present invention provides electrical apparatus comprising a stand, an appliance supportable by the stand, an electrical connector device, an electrical socket in said connector device, an electrical plug on said appliance and releasably engagable in said socket, and coupling means comprising first detents to mechanically couple said stand to said electrical connector device, second detents to mechanically couple said connector device to said appliance, and a bistable mechanism which is manually actuable to switch between a first state in which the first detents are effective the second detents are noneffective, and a second state in which the second detents are effective and the first detents non-effective.

The apparatus preferably includes actuating means comprising at least one manually movable member which is operable to actuate the bistable mechanism, which member or members may be provided on the connector device and/or the appliance, but is or are preferably provided on the stand.

The couplings or coupling means preferably comprise detents; which detents are preferably in the form of catch or bolt parts movable to engage in respective sockets in the stand, connector device or appliance, but may be in the form of movable keep members movable to retain fixed projections e.g. on the stand or appliance, in sockets e.g. in the connector device.

The appliance may be of any suitable form. For example, an iron of relatively low heat storage capacity or an electric drill of small electrical charge storage capacity can be employed for light or spasmodic use as a cordless appliance or for heavier or continuous use as a corded appliance, upon a single rapid manual actuation of the mechanism.

The bistable switchable mechanism and couplings together constitute locking means to selectively interlock the connector device with either the stand or the appliance.

The bistable form of mechanism greatly reduces risks to the user, because unlike corded appliances having a separable electrical connector, the bistable mechanism prevents accidental detachment of the connector device from the appliance, but yet permits simple and rapid lifting separation thereof, without any pulling or forceful manipulation of the device and appliance, when the appliance and connector device are placed on the stand and the bistable mechanism is actuated to cause the detents to release the appliance and engage the stand.

The arrangement of the apparatus is preferably such that actuation of the mechanism is hindered, prevented or made difficult except at times wherein the connecting device is correctly positioned on the stand.

BRIEF DESCRIPTION OF THE DRAWINGS

The invention will be described further, by way of example, with reference to the accompanying diagrammatic drawings, wherein.

DETAILED DESCRIPTION OF THE DRAWINGS

Figure 1:
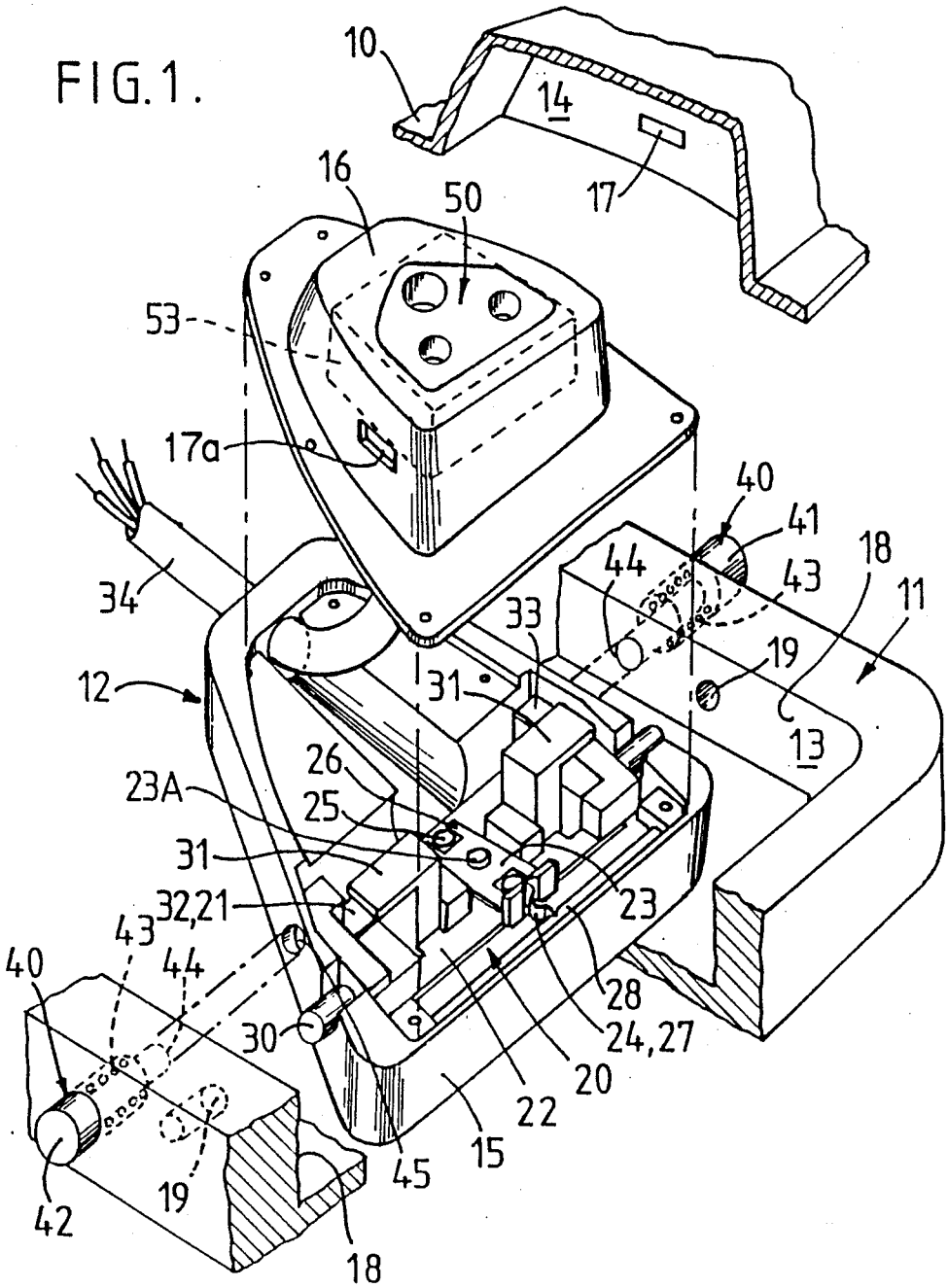
FIG. 1 shows a partially exploded perspective diagram of a connector device with parts of a stand and an appliance of an embodiment of apparatus of the invention.

The apparatus comprises an electrical appliance 10, a stand 11 and an electrical connector device 12.

The stand and the appliance each have a concavity 13 or 14 shaped to receive a respective lower or upper male portion 15 or 16 of the device 12. The concavities 13 and 14 may be dimensioned so that the appliance can abut or rest directly upon the stand with the device accommodated in the concavities, or so that the device is interposed between and separates the stand and the appliance, when the appliance is in a resting position.

The apparatus incorporates a bistable mechanism 20 to actuate first coupling means and second coupling means, as hereinbefore described. The device 12 comprises two bolt members 21 and 22 slidably mounted in the device, a cross link 23 supported for arcuate movement about a central axis defined by a pivot 23A, and an over-center bias device 24. The members 21 and 22 each have a peg 25, which pegs 25 slidably engage in forked ends 26 of the link so that the members 21 and 22 are mechanically coupled to move in unison in opposite directions for movements between limits provided by stops e.g. provided by walls of the lower portion 15. The over-center bias device 24 renders the mechanism unstable except in two stable positions in which one or the other or both of the members 21 and 22 abuts one or the other or respective ones of the stops; and comprises a spring or springs 27 acting between the mechanism and a static part 28 to urge the mechanism out of any intermediate position into the nearest of the stable positions.

Referring to FIGS. 1 to 4 in the first embodiment, the bistable mechanism 20 is disposed in the lower male portion 15 and is directly connected to the coupling means comprising first detent projections 30 and second detent projections 31.

Each member 21 or 22 provides one stand engagement projection 30 at one end and one appliance engaging projection 31 at the other, and the members 20 and 21 are oppositely oriented so that the projection 30 of one member lies below and near to the projection 31 of the other member.

Figure 2:
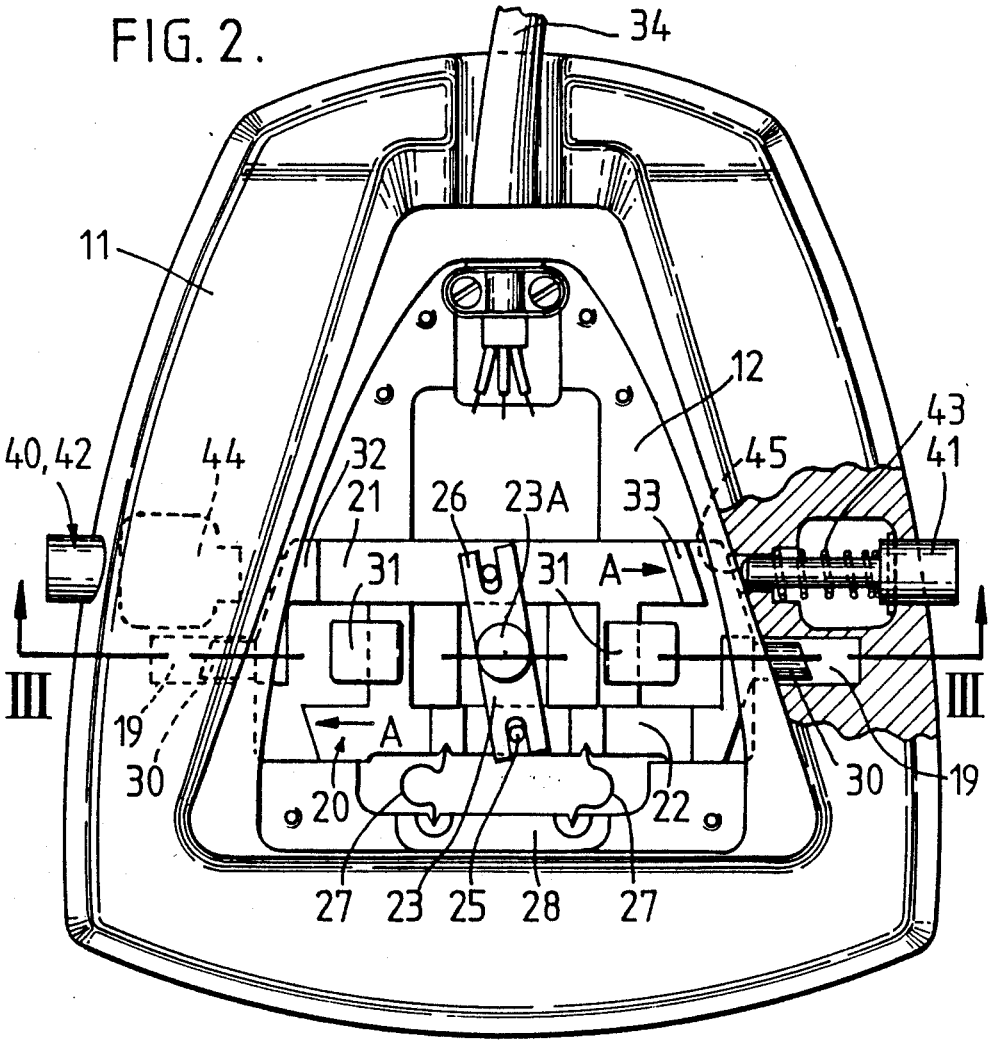
FIG. 2 shows a partially cut-away plan view of the connector device in situ on the stand and with an upper portion removed to show a bistable mechanism.
Figure 3:
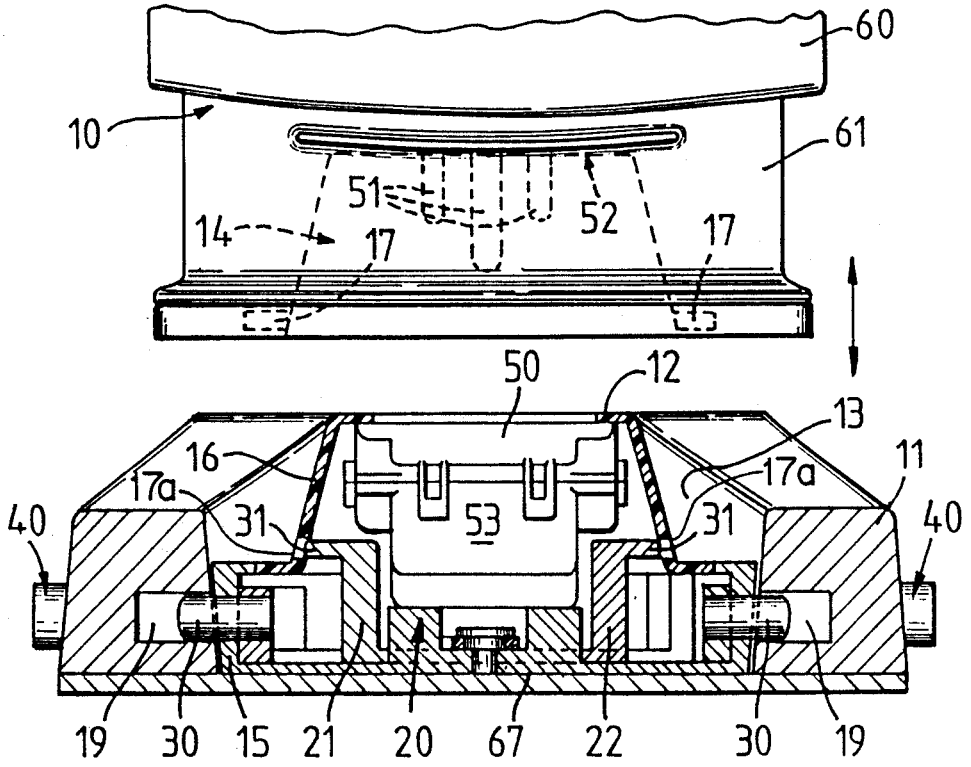
FIG. 3 shows a vertical section through the stand and connector device on the line III—III in FIG. 2 and a partial view of the appliance raised thereabove.
Figure 4:
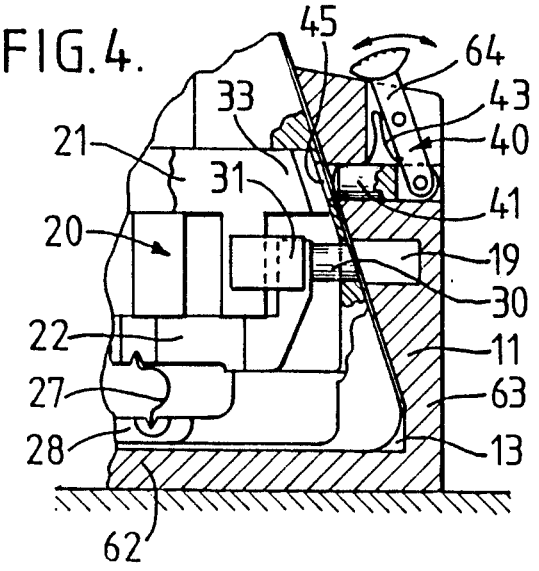
FIG. 4 shows a detail of the mechanism shown in FIGS. 1 and 2, in situ on part of a modified form of the stand.

In the first of the two stable positions the projections 30 are extended to project from opposite sides of the lower portion 15 while the projections 31 are retracted into the upper portion 16; and in the second position the projections 30 are retracted and the projections 31 project through apertures 17*a* from opposite sides of the upper portion 16. In FIGS. 1 to 3, the members are shown in the first position and are movable as indicated by arrows A into the second position (FIG. 4).

The concavity 13 has a wall 18 in which opposed sockets 19 are provided to receive the projections 30 to mechanically couple the device 12 to the stand 11.

The concavity 14 has a wall in which opposed sockets 17 are provided to receive the projections 31 to mechanically couple the device 12 to the appliance 10 and retain the portion 16 in the concavity 14.

The apparatus includes manually operable control means 40 for actuating the mechanism 20. In the embodiment shown in FIGS. 1 to 3, the control means 40 comprises first and second actuators in the form of displaceable plungers 41 and 42 which are mounted on the stand 11 so as to be movable from retracted positions to extended positions against the thrusts of bias springs 43. In the extended position the plunger 41 or 42 extends through an aperture 44 in said wall 18 into the concavity 13 adjacent to the socket 19. The apertures 44 are aligned with apertures 45 in the lower portion 15 to permit entry of the plungers 41 and 42 to engage abutments 32 and 33 provided on the ends of the members 21 and 22.

In the embodiment shown in FIGS. 1 to 3 the stand 11 constitutes a base on which the appliance stands. In FIG. 3 the appliance 10 is represented as an electric iron having a heated sole plate 60 and a rear end portion 61 in which the concavity 14 is provided, and the iron rests on the stand with its sole plate 60 upstanding; whereas in the variation shown in FIG. 4 the stand 11 provides a sole supporting base portion 62 and a rear position 63 in which the concavity 13 is provided.

Also shown in FIG. 4 is a variation of the control means 40 in which the plungers 41 and 42 are movable via levers 64.

Figure 7:
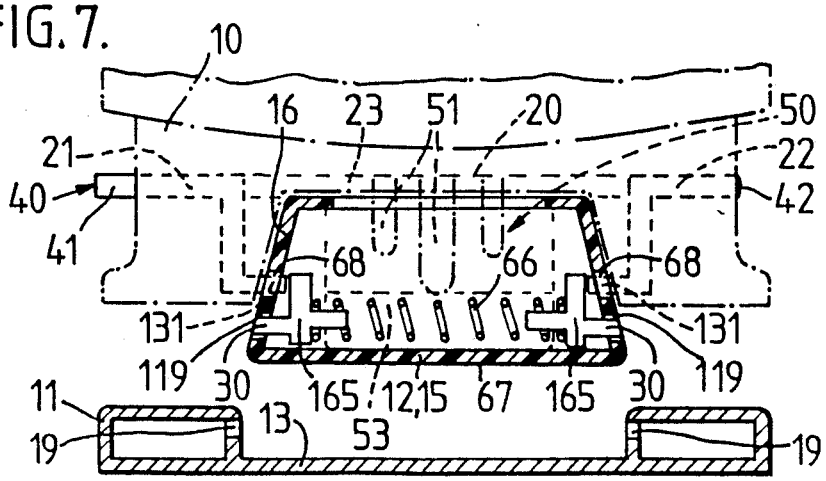
FIG. 7 is a part-sectional view of a third arrangement of the mechanism, stand, appliance and connector device in a state corresponding to corded operation of the appliance.
Figure 5:
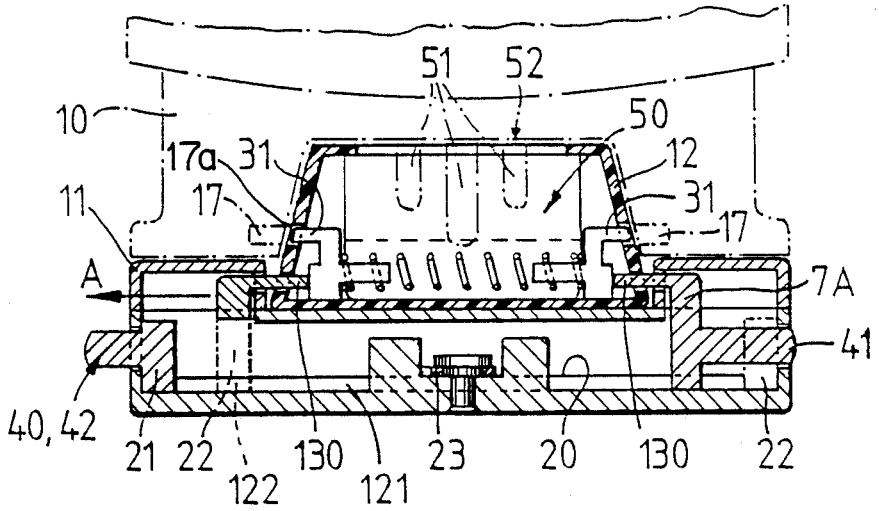
FIGS. 5 and 6 show sectional views of a second arrangement of the mechanism, stand and connector device in states corresponding respectively to cordless and corded operation of an appliance partially indicated in broken lines.
Figure 6:
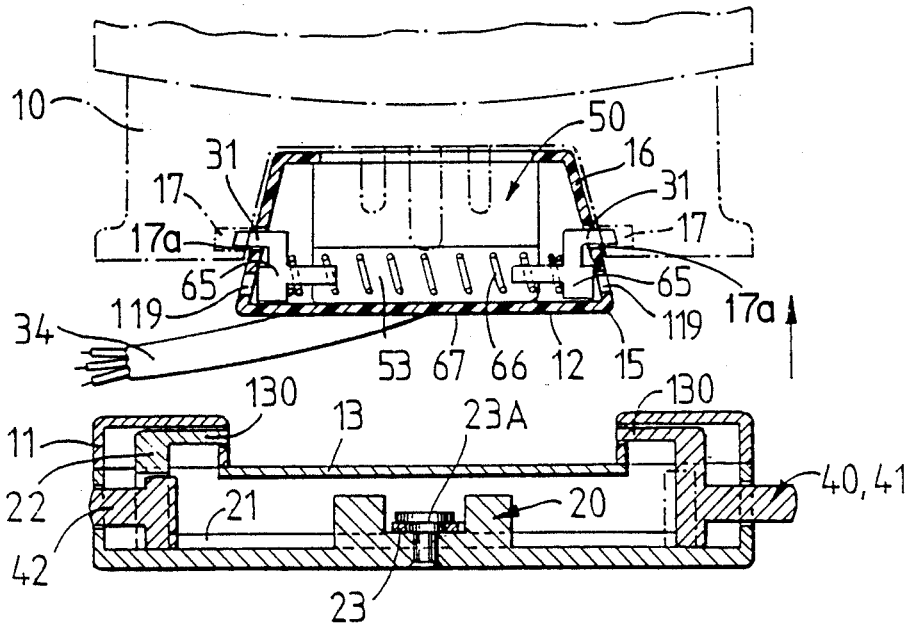

Instead of being disposed in the device 12, the bistable mechanism 20 may be disposed in the stand 11 as shown in FIGS. 5 and 6, or in the appliance 10 as shown in FIG. 7.

Referring to FIGS. 5 and 6, the bistable mechanism 20 is dimensionally extended by lengthening intermediate portions 121 and 122 of the bolt members 21 and 22 which otherwise cooperate with the cross-link 23 as described; the directions of the first detents are reversed so that the members 21 and 22 carry projections 130 which are movable to project from the stand inwards into the recess 13 to engage in the connector device 12; and a modified form of one of the projections 30 on one end of the member 21 is utilized to form the plunger 41, while the other plunger 42 extends slidably past part of the member 22 from the other end of the member 21. The device 12 now houses only the second detents 31 which are carried on respective sliders 65 which are mutually biased apart by a spring 66. In the first stable condition (shown in FIG. 5) in which the plunger 41 is depressed, the first detent projections 130 project through socket apertures 119 in the lower portion 15 to engage and thrust the sliders 65 inwards to hold the detents 31 in a retracted, non-effective, state; whereas in the second stable condition (shown in FIG. 6) in which the plunger 42 is depressed, the projections 130 are retracted into the stand, thus allowing the detents 31 to project and engage in the sockets 17 in the appliance.

Referring to FIG. 7, the bistable mechanism 20 (shown in the second stable state) is disposed in the appliance in a position offset from the concavity 14, but for the parts of members 21 and 22 carrying projections 131 which are extended to bring these projections into alignment with socket apertures 68 in the upper portion 16 so that the projections 131 can engage in the apertures to serve as the second detents. The device 12 now houses only the first detents 30 which are carried by sliders 165 (equivalent to inverted forms of the sliders 65) similarly biased by the spring 66, so that the detents 30 are movable, upon retraction of the second detents, to extend through the apertures 119 into socket apertures 19 in the stand 11. In this embodiment also, the member 21 carries the plungers 41 and 42 of the control means 40 which is now provided on the appliance.

All embodiments are essentially mechanically equivalent in that a single mechanism controls, upon a single manual actuation, a change of state in which one said detent coupling means is rendered effective with simultaneous rendering of the other said detent coupling means non-effective, which mechanism is bistable to hold or lock one or both detent coupling means in the selected state.

In all embodiments the device 12 incorporates an electrical connector, e.g. a socket connector 50 to make electrical contact with terminals 51 of a plug 52 of the appliance; and incorporates an electrical switch device 53 (FIG. 3) actuated upon insertion of the upper portion 16 into the concavity 14 to close or complete a conductive path or paths within the device between the connector and an electrical supply cable 34 connected to the connector 50 of device 12. The connector and switch are preferably an assembly, such as that disclosed in U.S. Pat. No. 4,707,042.

In all embodiments the lower portion 15 of the connector device 12 provides a bottom 67 shaped, e.g. flat, to permit the connector device, with or without the appliance coupled thereto, to be stood upright on another surface, such as a table top surface or an ironing board surface.

In use, the apparatus may be mechanically switched to permit the appliance to be used in either corded or cordless manner, simply by displacing the appropriate plunger to engage the respective abutment and displace the mechanism to the appropriate stable state.

The invention is not confined to details of the foregoing example and includes within its scope novel features or combinations of features disclosed herein, or mechanical equivalents of such features or combinations. For example the invention provides a connector device as disclosed or which comprises an electrical connector and any suitable form of switchable mechanism permitting the device to be releasably connected to either of an appliance and a support stand for the appliance.

The invention further provides and includes functionally equivalent apparatus such as apparatus comprising a base, stand or like support and an electrical connector device, in which the connector device comprises detents or like catches to engage and secure the connector or device to an appliance (or to the support), and in which the support (or the appliance) comprises a bistable mechanism switchable between a retaining condition in which the mechanism engages and retains the connector device and releases the detents or catches from the appliance (or the support), and a releasing condition in which the mechanism is disengaged from the connector device and releases the detents or catches to engage the appliance (or the support).

In such apparatus a pair of plungers, of which at least one is manually actuable in a manner similar to that aforementioned, may, as in the first embodiment, be separate from the mechanism instead of being interconnected by the mechanism as in the embodiments of FIGS. 5, 6 and 7. The mechanism may be of detent locking form similar to the aforementioned bistable mechanism.

In all forms of the apparatus the detents or equivalent coupling engagement means may be of any suitable form, e.g. the projections or detents aforementioned, and are preferably easily releasable only when the appliance is directly or indirectly supported by the support or stand (without recourse to excessive force or an implement not forming part of the apparatus).

I claim:

1. Electrical apparatus comprising:
(a) a stand, an appliance supportable by the stand, and an electrical connector device located between said stand and said appliance;
(b) electrical socket means in said connector device;
(c) electrical plug means on said appliance and releasably engaged in said socket means;
(d) first detent means to mechanically couple said stand to said electrical connector device, second detent means to mechanically couple said connector device to said appliance;
(e) a bistable mechanism operative to actuate said first and second detent means; and
(f) manually actuable means at a location separate from said electrical connector device operative to switch the bistable mechanism between a first state in which the first detent means couples said stand to said device and the second detent means does no coupling, and a second state in which the second detent means couples said device to said appliance and the first detent means does no coupling.

2. An electrical apparatus as claimed in claim 1, wherein
the electrical connector device comprises a first male portion and a second male portion, said first male portion includes switch means being operable by insertion of said plug means into said socket means to energize said socket means.

3. An electrical connector device as claimed in claim 2 wherein side walls of said first male portion are apertured for passage of said second detent means; and wherein side walls of said second male portion are apertured for passage of said first detent means.

4. An electrical connector device as claimed in claim 2 wherein said bistable mechanism is housed in said second male portion and is mechanically connected to said first and second detent means.

5. Electrical apparatus as claimed in claim 1 wherein the bistable mechanism is housed in said connector device; and wherein the manually actuable means is housed in said stand.

6. Electrical apparatus as claimed in claim 1 wherein said bistable mechanism is housed in said stand.

7. Electrical apparatus as claimed in claim 1 wherein said bistable mechanism is housed in said appliance 8. Electrical apparatus as claimed in claim 1 wherein said manually actuable means comprises actuators mounted on said mechanism, and
said mechanism carries one of said detent means and controls the other of said detent means via said one of the detent means.

9. Electrical apparatus comprising:
(a) a stand, an appliance supportable by the stand, and an electrical connector device located between the stand and said appliance;

(b) electrical socket means in said connector device;

(c) electrical plug means on said appliance and releasably engaged in said socket means;

(d) first detent means movable between an operative position mechanically coupling said stand to said electrical connector device and an inoperative position in which it does no coupling;

(e) second detent means movable between an operative position mechanically coupling said connector device to said appliance and an inoperative position in which it does no coupling;

(f) a bistable mechanism operatively associated with said first and second detent means and switchable reversibly between a first stable condition actuating the first detent means to its operative position and actuating the second detent means to its inoperative position, and a second stable condition actuating the first detent means to its inoperative position and actuating the second detent means to its operative position; and (g) manually actuable means disposed solely on one of said stand, appliance and connector device, and actuable by a single manual displacement to switch the bistable mechanism between said first and second stable conditions to effect simultaneous actuation of said first and second detent means.

10. An electrical apparatus as in claim 9, wherein the appliance carries the manually actuable means and said mechanism.

11. Electrical apparatus as claimed in claim 9 wherein said mechanism comprises two bolt members each of which carries at least one of said detent, and is slidably mounted for reciprocal movement relative to the other bolt member and is linked to the other bolt member by a cross-link.

* * * * *